US009803148B2

(12) United States Patent
Koseoglu et al.

(10) Patent No.: US 9,803,148 B2
(45) Date of Patent: Oct. 31, 2017

(54) HYDROCRACKING PROCESS WITH INTERSTAGE STEAM STRIPPING

(75) Inventors: Omer Refa Koseoglu, Dhahran (SA); Ali H. Al-Abdul'al, Qatif (SA); Masaru Ushio, Kanagawa (JP); Koji Nakano, Fukuoka (JP)

(73) Assignees: Saudi Arabian Oil Company, Dhahran (SA); Japan Cooperation Center, Petroleum, Tokyo (JP); JGC Catalysts and Chemicals Ltd., Kanagawa (JP)

( * ) Notice: Subject to any disclaimer, the term of this patent is extended or adjusted under 35 U.S.C. 154(b) by 1184 days.

(21) Appl. No.: 13/559,846

(22) Filed: Jul. 27, 2012

(65) Prior Publication Data

US 2013/0098802 A1 Apr. 25, 2013

Related U.S. Application Data

(60) Provisional application No. 61/513,029, filed on Jul. 29, 2011.

(51) Int. Cl.
*C10G 67/02* (2006.01)
*C10G 65/12* (2006.01)

(52) U.S. Cl.
CPC ..... *C10G 67/02* (2013.01); *C10G 65/12* (2013.01); *C10G 2300/301* (2013.01);
(Continued)

(58) Field of Classification Search
CPC ..... C10G 65/04; C10G 65/10; C10G 65/12; C10G 67/02; C10G 2300/301;
(Continued)

(56) References Cited

U.S. PATENT DOCUMENTS 3,240,694 A 3/1966 Mason et al.
3,377,267 A * 4/1968 Spars ..... C10G 47/00 208/100
(Continued)

FOREIGN PATENT DOCUMENTS

EP 665281 A2 8/1995
JP H06-065583 A 3/1994
(Continued)

OTHER PUBLICATIONS

International Search Report and Written Opinion issued by the EPO in PCT Application No. PCT/US2012/048559 dated Oct. 5, 2012, 8 pp.
(Continued)

*Primary Examiner* — Prem C Singh
*Assistant Examiner* — Brandi M Doyle
(74) *Attorney, Agent, or Firm* — Abelman, Frayne & Schwab

(57) ABSTRACT

In a hydrocracking process, the product from the first stage reactor passes through a steam stripper to remove hydrogen, $H_2S$, $NH_3$, light gases ($C_1$-$C_4$), naphtha and diesel products. The stripper bottoms are separated from hydrogen, $H_2S$, $NH_3$, light gases ($C_1$-$C_4$), naphtha, and diesel products and treated in a second stage reactor. The effluent stream from the second stage reactor, along with the stream of separated hydrogen, $H_2S$, $NH_3$, light gases ($C_1$-$C_4$), naphtha, and diesel products, are passed to a separation stage for separating petroleum fractions. Preferably, the effluent stream from the first stage reactor is passed through a steam generator prior to the steam stripping step. In an alternate embodiment, the effluent stream from the first stage reactor is passed through a vapor/liquid separator stripper vessel prior to the steam stripping step.

10 Claims, 4 Drawing Sheets

(52) U.S. Cl.
CPC ..... *C10G 2300/4093* (2013.01); *C10G 2300/807* (2013.01); *C10G 2400/02* (2013.01); *C10G 2400/04* (2013.01)

(58) Field of Classification Search
CPC ..... C10G 2300/807; C10G 2300/4093; C10G 2400/02; C10G 2400/04
See application file for complete search history.

(56) References Cited

U.S. PATENT DOCUMENTS

| | | | | |
|---|---|---|---|---|
| 3,642,610 | A | 2/1972 | Divijak et al. | |
| 3,855,113 | A | 12/1974 | Gould | |
| 3,928,173 | A | 12/1975 | James | |
| 4,394,249 | A | 7/1983 | Shen | |
| 4,400,265 | A | 8/1983 | Shen | |
| 4,521,295 | A | 6/1985 | Chervenak et al. | |
| 4,828,675 | A | 5/1989 | Sawyer et al. | |
| 4,828,676 | A | 5/1989 | Sawyer et al. | |
| 4,935,120 | A | 6/1990 | Lipinski et al. | |
| 4,950,384 | A | 8/1990 | Groeneveld et al. | |
| 4,994,168 | A | 2/1991 | Harandi | |
| 4,994,170 | A | 2/1991 | Lipinski et al. | |
| 5,073,249 | A | 12/1991 | Owen | |
| 5,164,070 | A | 11/1992 | Munro | |
| 5,275,719 | A | 1/1994 | Baker et al. | |
| 5,447,621 | A | 9/1995 | Hunter | |
| 5,453,177 | A | 9/1995 | Goebel et al. | |
| 5,705,052 | A | 1/1998 | Gupta | |
| 6,042,716 | A | 3/2000 | Morel et al. | |
| 6,103,104 | A | 8/2000 | Gupta | |
| 6,217,746 | B1 | 4/2001 | Thakkar et al. | |
| 6,221,239 | B1 | 4/2001 | Morel et al. | |
| 6,270,654 | B1 | 8/2001 | Colyar et al. | |
| 6,436,279 | B1 * | 8/2002 | Colyar | C10G 45/16 208/107 |
| 6,451,198 | B2 | 9/2002 | Morel et al. | |
| 6,454,932 | B1 | 9/2002 | Baldassari et al. | |
| 6,517,705 | B1 | 2/2003 | Kalnes et al. | |
| 6,620,311 | B2 | 9/2003 | Morel et al. | |
| 6,623,622 | B2 | 9/2003 | Gupta | |
| 6,632,350 | B2 | 10/2003 | Gupta et al. | |
| 7,128,828 | B1 | 10/2006 | Kalnes | |
| 7,279,090 | B2 | 10/2007 | Colyar et al. | |
| 7,560,020 | B2 | 7/2009 | Annamalai et al. | |
| 7,588,678 | B2 | 9/2009 | Barthelet et al. | |
| 2001/0013485 | A1 | 8/2001 | Morel et al. | |
| 2003/0111386 | A1 | 6/2003 | Mukherjee et al. | |
| 2004/0173503 | A1 * | 9/2004 | Stupin et al. | 208/108 |
| 2006/0131212 | A1 * | 6/2006 | Dahlberg et al. | 208/59 |
| 2008/0023372 | A1 * | 1/2008 | Leonard et al. | 208/113 |
| 2008/0289996 | A1 * | 11/2008 | Gupta | C10G 65/10 208/59 |
| 2009/0095654 | A1 * | 4/2009 | Gupta et al. | 208/58 |
| 2009/0159493 | A1 * | 6/2009 | Bhattacharya | C10G 45/02 208/58 |
| 2009/0288988 | A1 | 11/2009 | Mayeur et al. | |
| 2010/0200458 | A1 | 8/2010 | Kalnes | |
| 2010/0200460 | A1 | 8/2010 | Brosten et al. | |
| 2011/0079541 | A1 * | 4/2011 | Koseoglu | 208/59 |

FOREIGN PATENT DOCUMENTS

| | | | |
|---|---|---|---|
| JP | H11-508957 | A | 8/1999 |
| JP | 2000017276 | A | 1/2000 |
| WO | 97/23584 | A1 | 7/1997 |

OTHER PUBLICATIONS

JP 2014-523068, Office Action dated Jan. 19, 2016, 3 pages.

* cited by examiner

HYDROCRACKING PROCESS WITH INTERSTAGE STEAM STRIPPING

CROSS REFERENCE TO RELATED APPLICATIONS

This application claims priority on U.S. provisional patent application No. 61/513,029, filed on Jul. 29, 2011, the contents of which are incorporated herein by reference.

BACKGROUND OF THE INVENTION

Hydrocracking processes are well known and are used in a large number of petroleum refineries. Such processes are used with a variety of feeds ranging from naphthas to very heavy crude oil residual fractions. In general, a hydrocracking process splits the molecules of the feed into smaller (lighter) molecules having higher average volatility and economic value. At the same time, a hydrocracking process normally improves the quality of the material being processed by increasing the hydrogen-to-carbon ratio of the materials, and by removing sulfur and nitrogen. The significant economic utility of the hydrocracking process has resulted in a large amount of developmental effort being devoted to the improvement of the process and to the development of better catalysts for use in the process.

A hydrocracking unit consists of the two principal sections for reaction and separation, the configuration and types of which vary. There are a number of known process configurations, including once-through, or series flow, two-stage once-through, two-stage with recycle, single stage and mild hydrocracking. Parameters such as feedstock quality, product specification, processing objectives and catalysts determine the configuration of the reaction section.

In the once-through configuration, two reactors are used. The feedstock is refined over hydrotreating catalysts in the first reactor and the effluents are sent to the second reactor containing amorphous or zeolite-based cracking catalyst(s). In the two-stage configuration, the feedstock is refined over hydrotreating catalysts in the first reactor and the effluents are sent to a fractionator column to separate the $H_2S$, $NH_3$, light gases ($C_1$-$C_4$), naphtha and diesel products boiling in the range nominal 36-370° C. Hydrocarbons boiling at a temperature above 370° C. are then recycled to the first stage reactor or the second reactor.

In both configurations, hydrocracking unit effluents are sent to a distillation column to fractionate the naphtha, jet/kerosene, diesel and unconverted products boiling in the nominal ranges 36-180° C., 180-240° C., 240-370° C. and above 370° C., respectively. The hydrocracking products jet/kerosene (i.e., smoke point>25 mm) and diesel products (i.e., cetane number>52) are of high quality and well above worldwide transportation fuel specifications.

One of the advantages of the two-stage configuration is that it maximizes the mid-distillate yields. The converted products from the first stage are fractionated and not subjected to further cracking in the second reactor, resulting in a high mid-distillate yield.

A conventional two-stage hydrocracking unit of the prior art with recycle is schematically illustrated in FIG. 1. In the configuration shown, the feedstock 11 is hydrocracked in the first reactor 10 over hydrotreating catalysts, usually amorphous-based catalysts containing Ni, Mo or Ni, W or Co, Mo metals as the active phase. The first reactor effluent stream 12 is then passed to fractionator 20 and the light fractions 21 containing $H_2S$, $NH_3$, $C_1$-$C_4$ gases, naphtha and diesel fractions boiling up to a nominal temperature of 370° C. are separated. The hydrocarbon fraction 22, boiling above 370° C. are sent to the second reactor 30 containing amorphous and/or zeolitic-based catalyst(s) containing Ni, Mo or Ni, W metals as the active phase. The second reactor effluents stream 31 is recycled to the fractionator 20 for separation of the lighter cracked components.

The configuration of the separation section depends upon the composition of the reactor effluent. The reactor effluents are sent either to a hot separator or a cold separator. In the latter case, the reactor effluents, after passing the feed/effluent exchangers, are sent to a high pressure cold separator. A portion of the unconverted recycle stream is withdrawn from the fractionators bottoms as bleed stream 24. The gases are then recycled back to the reactor after being compressed and the bottoms are sent to a low pressure low temperature separator for further separation.

In the hot scheme, the reactor effluents are passed through the exchangers and are sent to a high pressure hot separator, from which the gases are recycled to the reactor. The bottoms are sent to a high pressure cold separator and to a low pressure low temperature separator for further separation.

Hydrocracking units utilizing a cold separator are usually designed for processing lighter feedstocks ranging from naphtha to diesel. Hydrocracking units utilizing a hot separator are designed for heavier feedstocks, vacuum gas oil and heavier components. There are advantages and disadvantages to both schemes. The surface area of the feed/effluent heat exchangers is reduced significantly in the scheme utilizing a hot separator. It is not necessary to cool all the effluents to 40° C. and preheat the stripper as in the cold scheme. Because of the heat efficiency, this scheme also results in a heat gain for feed preheating, which is about 30-40% of the cold scheme furnace requirement. A disadvantage of the hot scheme is that the recycle gas is generally less pure than that obtained in the cold scheme, which results in a higher reactor inlet pressure. The hydrogen consumption is also slightly higher with the hot scheme due to a higher hydrogen solubility.

Single stage once-through hydrocracking is a milder form of conventional hydrocracking. Operating conditions for mild hydrocracking are more severe than the hydrotreating process and less severe than the conventional high pressure hydrocracking process. This process is a more cost-effective hydrocracking process, but results in reduced product yields and quality. Mild hydrocracking processes produce less mid-distillate products of relatively lower quality compared to conventional hydrocracking process. Single or multiple catalysts systems can be used and their selection is based upon the feedstock processed and product specifications. Both hot and cold processing schemes can be used for mild hydrocracking, depending upon the process requirements. Single-stage hydrocracking uses the simplest configuration and these units are designed to maximize mid-distillate yield using a single or dual catalyst system. Dual catalyst systems are used in a stacked-bed configuration or in two series reactors.

Single-stage hydrocracking units can operate in a once-through mode or in recycle mode with recycling of the unconverted feed to the reactor. Hydrotreating reactions take place in the first reactor, which is loaded with an amorphous-based catalyst. Hydrocracking reactions take place in the second reactor over amorphous-based catalysts or zeolite-based catalysts. In the series-flow configuration, hydrotreated products are sent to the second reactor. In the recycle-to-extinction mode of operation, the reactor effluents from the first stage together with the second stage effluents are sent to the fractionators for separation, and the unconverted bottoms, free of $H_2S$ and $NH_3$, are sent to the second stage. There are also variations of the two-stage configuration.

It is known in the prior art to use steam stripping to separate light components such as $C_1$-$C_4$ gases, and $H_2S$ and $NH_3$. U.S. Pat. No. 6,042,716 discloses a process in which gas oil and hydrogen are reacted in the presence of a catalyst for deep desulfurization and deep denitrogenation. The effluent is steam stripped to separate the gas phase, and the liquid phase is dearomatized by reaction with hydrogen in the presence of a catalyst. In the examples given, the gas oil boils in the range of 184-394° C. and steam stripping is used to separate the gas phase from the liquid phase. Steam stripping is commonly used in refining operations to strip the hydrocarbon gases methane, ethane, propane and butanes and heteroatom-containing gases such as $H_2S$ and $NH_3$.

In U.S. Pat. No. 5,164,070, steam is used to remove light gases and naphtha. However, the cut point is naphtha, the end boiling point of which is 180° C. In the process described, steam is preferably charged to the bottom of the stripping column through line 7 to effect stripping of the lighter hydrocarbons and more volatile materials from the entering liquids. Alternatively, a reboiler may be placed at the bottom of the stripping column to effect or aid in achieving the desired degree of stripping. The stripping column is intended to remove a large majority of naphtha boiling hydrocarbons from the entering liquid streams and to also remove essentially all lower boiling hydrocarbons. The remaining heavier hydrocarbons are discharged through line 8 as the net bottoms stream of the stripping column.

U.S. Pat. No. 5,447,621 discloses a mid-distillate upgrading process where steam is used to remove the volatile components but not the heavy fractions like diesel, which is the feedstock in this patent.

The processes disclosed in U.S. Pat. No. 5,453,177 and U.S. Pat. No. 6,436,279 utilize steam stripping to remove light end components.

U.S. Pat. No. 7,128,828 discloses a process which removes low boiling, non-waxy distillate hydrocarbons overhead using a vacuum steam stripper.

U.S. Pat. No. 7,279,090, steam stripping is used to separate the hydrocarbon fractions boiling in the range of 36-523° C. in a process that integrates solvent deasphalting and ebullated-bed residue conversion of vacuum residue feedstock boiling at 523° C., and higher and steam stripping is used to separate the residue from the other fractions boiling at 523° C. and below.

A number of references disclose the use of multiple hydrocracking zones within an overall hydrocracking unit. The terminology "hydrocracking zones" is employed herein as hydrocracking units often contain several individual reactors. A hydrocracking zone may contain two or more reactors. For instance, U.S. Pat. No. 3,240,694 illustrates a hydrocracking process in which a feed stream is fed into a fractionation column and divided into a light fraction and a heavy fraction. The light fraction passes through a hydrotreating zone and then into a first hydrocracking zone. The heavy fraction is passed into a second, separate hydrocracking zone, with the effluent of this hydrocracking zone being fractionated in a separate fractionation zone to yield a light product fraction, an intermediate fraction which is passed to the first hydrocracking zone and a bottoms fraction which is recycled to the second hydrocracking zone.

U.S. Pat. No. 4,950,384 entitled "Process for the hydrocracking of a hydrocarbonaceous feedstock" separates the first stage reactor effluent using a flash vessel. A hydrocarbonaceous feedstock is hydrocracked by contacting the feedstock in a first reaction stage at elevated temperature and pressure in the presence of hydrogen with a first hydrocracking catalyst to obtain a first effluent, separating from the first effluent a gaseous phase and a liquid phase at substantially the same temperature and pressure as prevailing in the first reaction stage, contacting the liquid phase of the first effluent in a second reaction stage at elevated temperature and pressure in the presence of hydrogen and a second hydrocracking catalyst to obtain a second effluent, obtaining at least one distillate fraction and a residual fraction from the combination of the gaseous phase and the second effluent by fractionation, and recycling at least a part of the residual fraction to a reaction stage.

U.S. Pat. No. 6,270,654 describes a catalytic hydrogenation process utilizing multi-stage ebullated bed reactors with interstage separation by flashing between the series of ebullated bed reactors. This process is carried out only on residual feedstocks boiling above 520° C.

U.S. Pat. No. 6,454,932 describes multiple-stage ebullating bed hydrocracking with interstage stripping and separating that employs a separation step, and stripping with hydrogen between the ebullated bed reactors. The process is carried out on feedstocks boiling at 650° C. and above, and is used on both vacuum distillates and residues.

U.S. Pat. No. 6,620,311 discloses a process for converting petroleum fractions that includes an ebullated bed hydroconversion step, a separation step, a hydrodesulfurization step, and a cracking step that utilizes a steam stripper.

U.S. Pat. No. 4,828,676 and U.S. Pat. No. 4,828,675 disclose a process in which a sulfur-containing feed is hydrogenated, stripped, and reacted with hydrogen in a second stage. Steam stripping is used to remove $H_2S$ (but not naphtha and diesel products) as shown in—col. 10, 1. 11; col. 11, 1. 7-10; col. 25, 1. 18-22.

Gupta U.S. Pat. No. 6,632,350 and U.S. Pat. No. 6,632,622 disclose a two stage vessel with stripping of first stage effluents in the same vessel. Gupta U.S. Pat. Nos. 6,103,104 and 5,705,052 disclose a two stage vessel with stripping of first stage effluents in a separate stripper vessel. The processes disclosed in the Gupta patents also remove dissolved gas in liquid with steam stripping.

U.S. Pat. No. 7,279,090 uses steam stripping to separate naphtha, diesel and VGO fractions boiling in the range 36-523° C. However, this patent claims an integrated process processing vacuum residue feedstock boiling at 523° C. and higher.

SUMMARY OF THE INVENTION

The present invention is a process for hydrocracking a hydrocarbon feedstock. Feedstock is supplied to an input of a first stage reactor for removal of heteroatoms and cracking of high molecular weight molecules into low molecular weight hydrocarbons. The effluent stream from the outlet of the first stage reactor is passed through a steam stripper vessel to remove hydrogen, $H_2S$, $NH_3$, light gases ($C_1$-$C_4$), naphtha, and diesel products. Stripper bottoms are removed from the stripper vessel separately from hydrogen, $H_2S$, $NH_3$, light gases ($C_1$-$C_4$), naphtha, and diesel products and supplied to an input of a second stage reactor. The effluent stream from an outlet of the second stage reactor, together with an effluent stream of hydrogen $H_2S$, $NH_3$, light gases ($C_1$-$C_4$), naphtha, and diesel products which has been removed from the steam stripper vessel, are then supplied to a separation stage for separating petroleum fractions.

Preferably, the effluent stream from the first stage reactor is passed through a steam generator prior to being supplied to the steam stripper vessel.

Alternatively, the effluent stream from the first stage reactor is passed through a vapor liquid separator stripper vessel prior to being supplied to the steam stripper vessel.

This invention will improve the hydrocracking process operations, particularly for existing units, by converting once-through configuration into two-stage configurations. The proposed configuration or improvement will improve the hydrocracking unit process performance yielding more of the desirable middle distillate products and less of the undesirable light gases $C_1$-$C_4$ and naphtha and will extend catalyst life as compared to existing processes.

By installing a steam stripping step between the first and second stages of the hydrocracking unit, the process performance and yields are improved substantially.

Thus, in contrast to known prior art systems which utilize a flash or distillation unit, the present invention utilizes a steam stripping between hydrocracking unit stages.

The use of steam stripping in accordance with the invention produces a simple solution for separating the hydrocracking first stage effluents efficiently and utilizes the second reactor volume effectively. There are several advantages: minimized cracking of light cracked products such as naphtha and mid-distillates resulting in high mid-distillate yields and lower naphtha and $C_1$-$C_4$ gas production, eliminating the poisoning effect of $H_2S$ by removing it and retaining higher catalyst activity in the second stage reactor.
Similarly, steam stripping is applied to remove all light gases formed.

The steam stripper separates the fraction boiling at and below 375° C. between the two hydrocracking stages, where vacuum gas oil boils in the range of 375-565° C. The steam stripping process step is more efficient than the flash separation and can be incorporated into existing hydrocracking unit configurations, where steam generators can readily be installed.

BRIEF DESCRIPTION OF THE DRAWINGS

The invention will be described in further detail below and with reference to the attached drawings in which the same and similar elements will be referred to by the same number, and where.

DETAILED DESCRIPTION OF THE INVENTION

Figure 1:
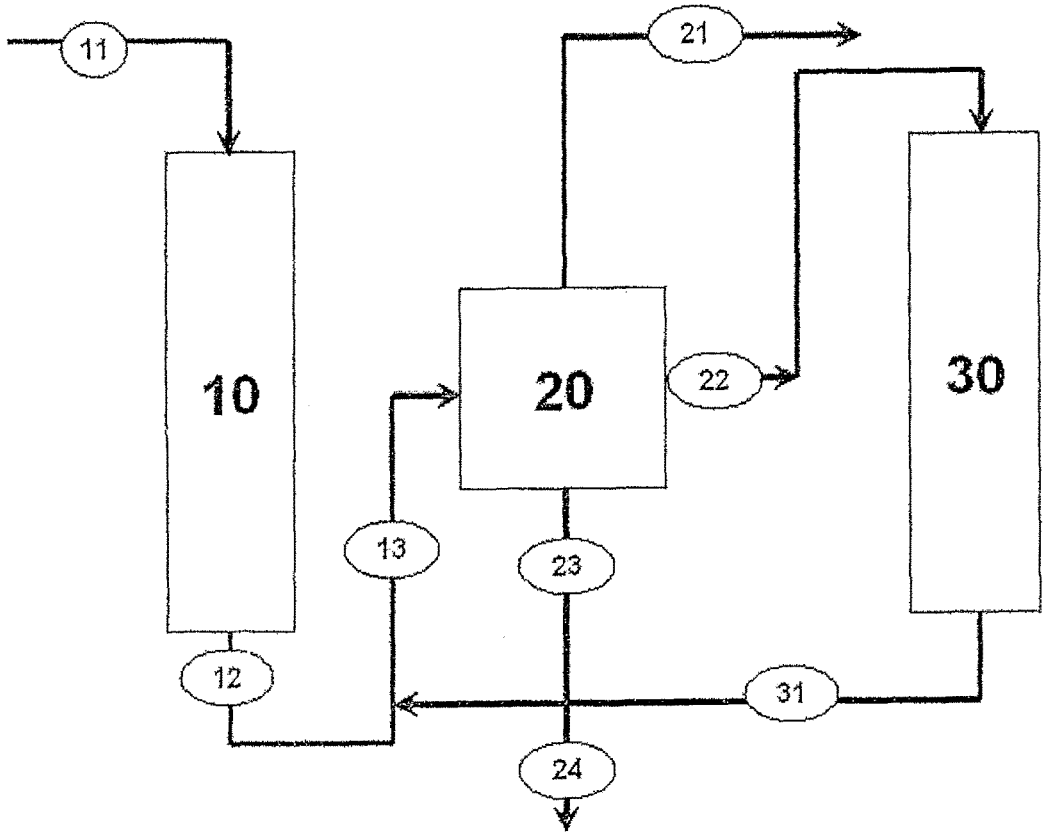
FIG. 1 is a schematic diagram of a conventional two-stage hydrocracking unit of the prior art.
Figure 2:
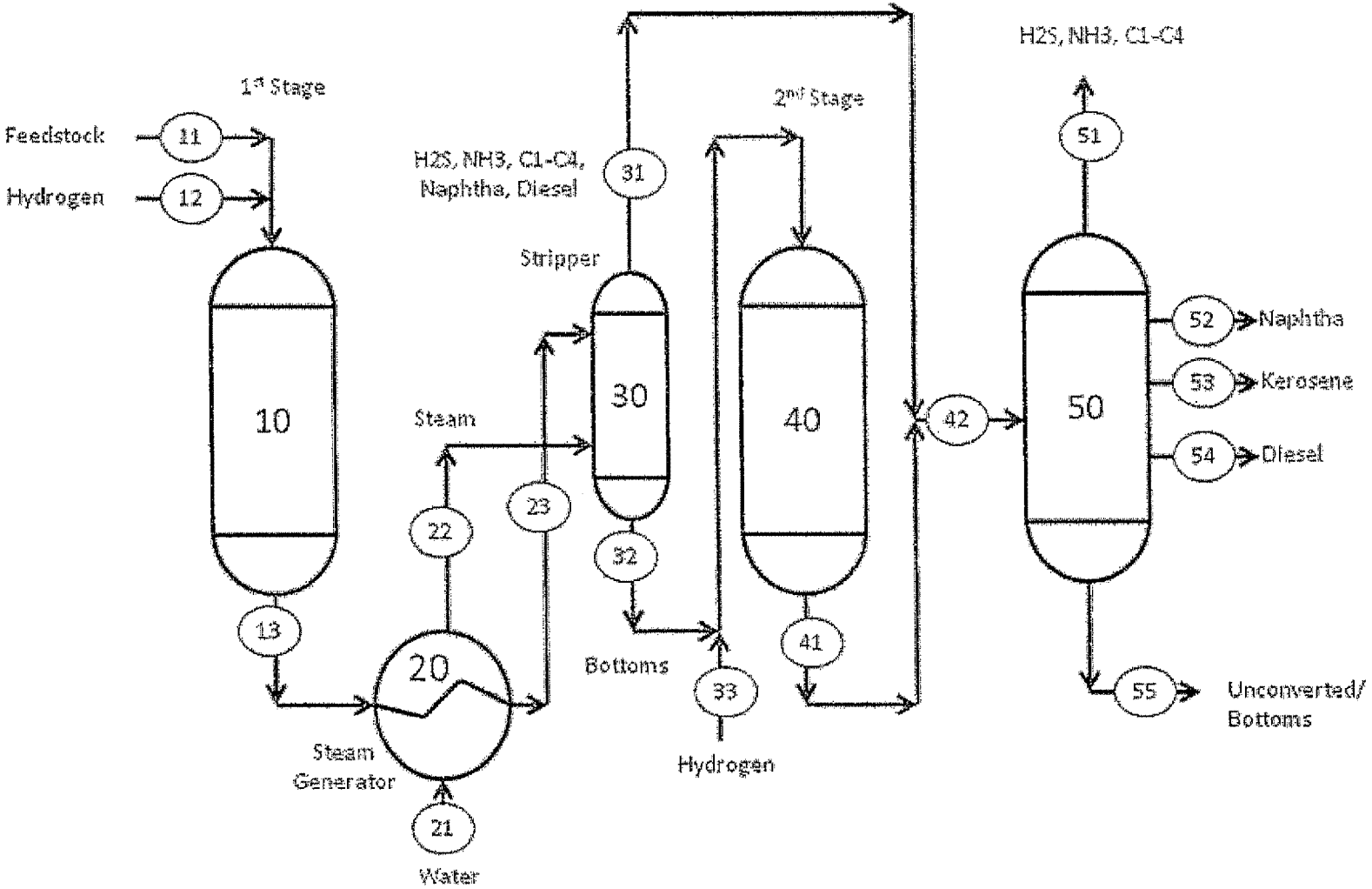
FIG. 2 is a schematic diagram of an embodiment of the present invention.

Referring to FIG. 2, the hydrocarbon feedstock stream 11 and a hydrogen stream 12 are fed to the first stage reactor vessel 10 for removal of heteroatoms containing sulfur, nitrogen and trace amounts of such metals as Ni, V, Fe, and also to crack high molecular weight, high boiling molecules into lower molecular weight, lower boiling hydrocarbons in the range 5-60 W %.

The effluent stream 13 is sent to a steam generating heat exchanger 20 to cool the reaction products and to generate a steam 22 from water 21. The cooled products 23 from the steam generator are sent to a steam stripper vessel 30 to remove hydrogen, $H_2S$, $NH_3$, light gases ($C_1$-$C_4$), naphtha and diesel products boiling in the nominal range of 36-370° C. The steam stripper is supplied with the steam 22 from the steam generator 20.

The stripper bottoms 32, free of light gases, $H_2S$, $NH_3$ and light fractions stream 31, are combined with a hydrogen stream 33 and sent to the second stage of the hydrocracking unit vessel 40. The second stage effluent stream 41 are combined with the light stripper products 31, and the combined stream 42 is sent to several separation and cleaning vessels including a fractionator vessel 50 to obtain final hydrocracking gas and liquid products.

Hydrocracker products include stream 51 containing $H_2S$, $NH_3$, light gases ($C_1$-$C_4$), naphtha stream 52 boiling in the range C5-180° C., kerosene stream 53 boiling in the range of 180-240° C., diesel stream 54 boiling in the range 240-370° C., and unconverted hydrocarbon fractions stream 55 boiling above 370° C.

Figure 3:
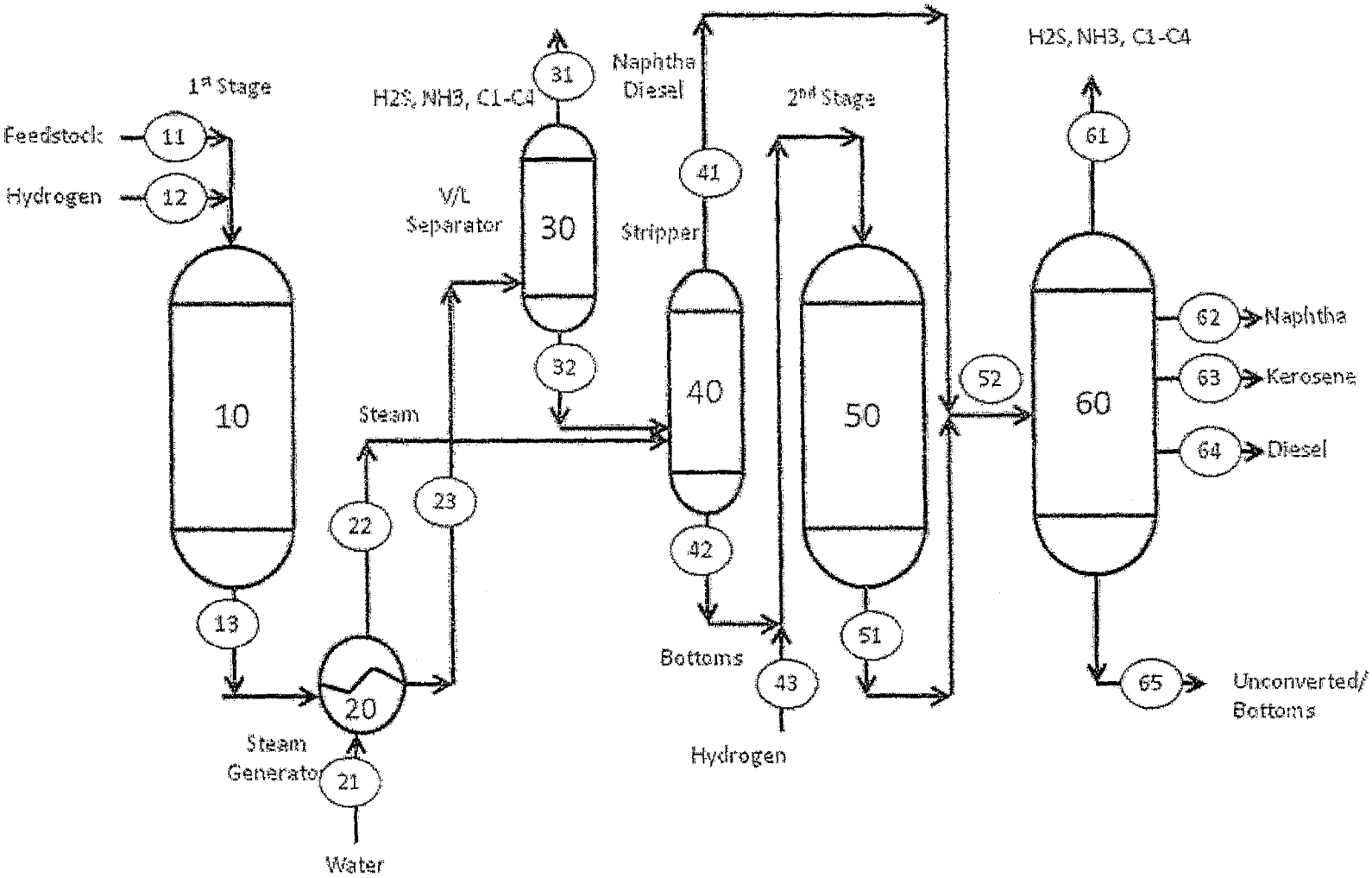
FIG. 3 is a schematic diagram of another embodiment of the present invention.

Referring now to the embodiment of FIG. 3, the hydrocarbon feedstock stream 11 and hydrogen stream 12 are fed to the first stage reactor vessel 10 for removal of heteroatoms containing sulfur, nitrogen and trace amounts of such metals as Ni, V and Fe, and also for the cracking of high molecular weight, high boiling molecules into lower molecular weight, lower boiling hydrocarbons in the range of from 5-60 W %. The effluent stream 13 is sent to a heat exchanger steam generator 20 to cool the reaction products and generate steam 22 from feed water 21. The cooled products 23 from the steam generator are sent to a vapor/liquid separator stripper 30 to remove the light gases including hydrogen, $H_2S$, $NH_3$ and $C_1$-$C_4$ hydrocarbons which exit as the effluent stream 31

The vapor/liquid separator bottoms stream 32 is sent to a steam stripper vessel 40 to remove naphtha and diesel products nominally boiling in the range of from 36-370° C. The steam stripper is fed by the steam 22 generated by the steam generator 20. The stripper bottoms 42, free of light gases, $H_2S$, $NH_3$ and light fractions, are combined with hydrogen stream 43 and sent to a second stage hydrocracking unit vessel 50.

The second stage effluent stream 51 is then combined with the light stripper products 41, and the combined stream 52 is sent to several separation and cleaning vessels including a fractionator vessel 60 to obtain final hydrocracking gas and liquid products. Hydrocracker products include $H_2S$, $NH_3$, light gases ($C_1$-$C_4$) stream 61, naphtha boiling in the range 36-180° C. stream 62, kerosene stream 63, diesel boiling in the range 180-370 C stream 64 and unconverted hydrocarbon fractions boiling above 370° C. stream 65.

Figure 4:
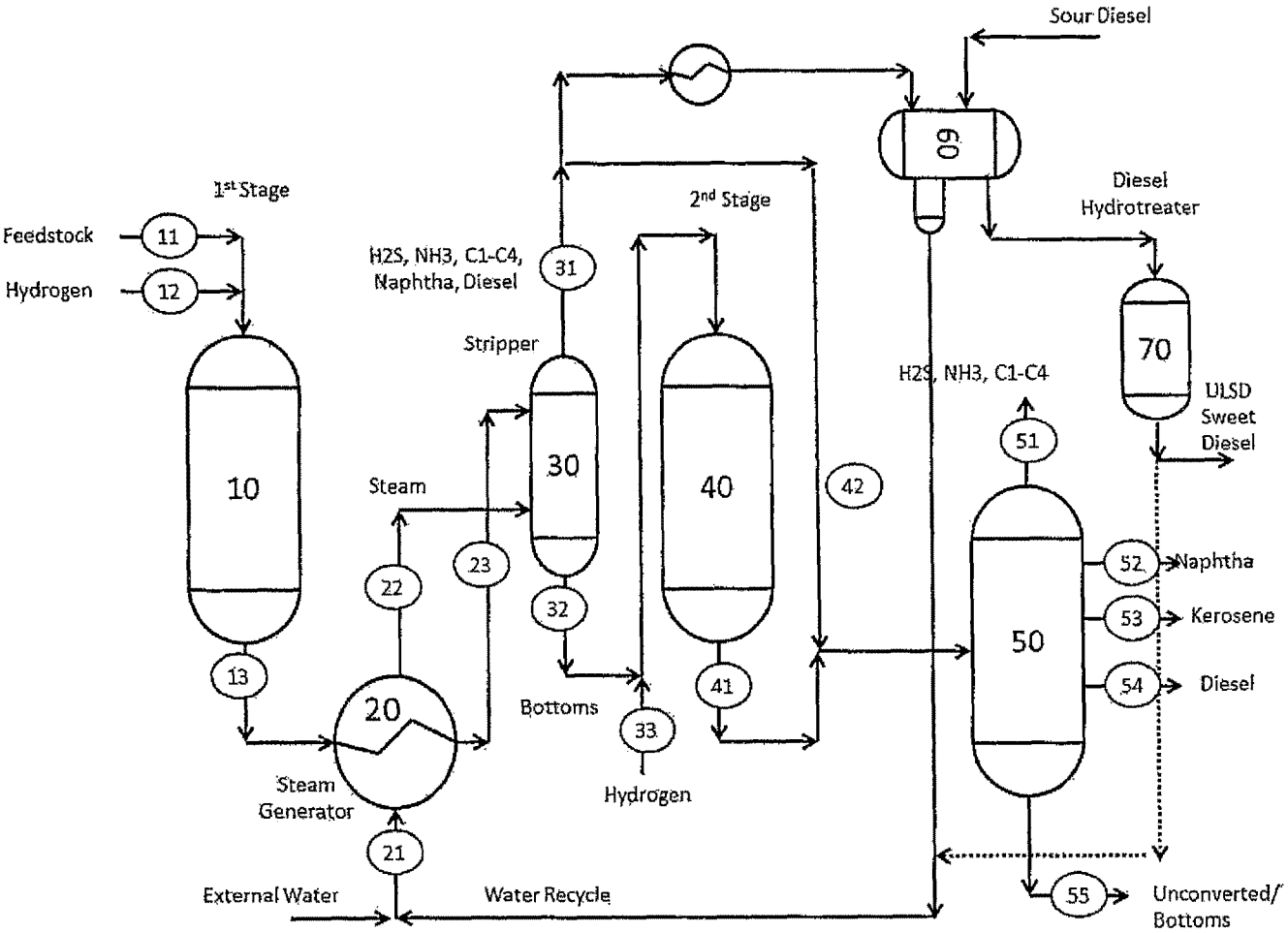
FIG. 4 is a schematic diagram of a further embodiment of the invention.

The embodiment shown in FIG. 4 includes unit operations performing processes similar to the embodiment of FIG. 2. In addition, however, the FIG. 4 embodiment includes a diesel hydrotreater for hydrotreating a diesel stream and a water recycle stream. As shown in FIG. 4, part of the stripper top stream 31 is passed through a steam generator to a separator vessel 60 to separate water, gas, and liquids. A portion of the water is extracted and sent back to the steam generator 20 and thereafter to stripper unit 30.

A sour diesel stream from the refinery is supplied to the vessel 60, combined with the top stream, and sent to the diesel hydrotreater 70 for ultra-low sulfur diesel production. The remaining water from the hydrotreater unit 70 is recycled to the stripper unit 30, while ultra-low sulfur, or sweet, diesel ("ULSD") from the hydrotreater is recovered for the market.

EXAMPLE

A feedstock blend containing 15 V % demetalized oil (DMO) and 85 V % vacuum gas oil (VGO) of which 64% is heavy VGO and 21% is light VGO, the properties of which are shown in Table 1, was subjected to hydrocracking over a catalytic system consisting of amorphous and zeolite supports promoted with Ni, W, Mo metals at 115 kg/cm$^2$ hydrogen partial pressure, 800 m$^3$ of feedstock over 1000 m$^3$ of catalyst per hour, 1,265 liters of hydrogen to oil ratio and at a temperature ranging from 370-385° C.

TABLE 1

| Property | Unit | Method | Blend |
|---|---|---|---|
| Specific Gravity | | | 0.918 |
| API Gravity | ° | ASTM D4052 | 22.6 |
| Sulfur | W % | ASTM D5453 | 2.2 |
| Nitrogen | ppmw | ASTM D5762 | 751 |
| Bromine Number | g/100 g | | 3.0 |
| Hydrogen | W % | ASTM D4808 | 12.02 |
| Simulated Distillation | | ASTM D7213 | |
| IBP | ° C. | | 210 |
| 10/30 | ° C. | | 344/411 |
| 50/70 | ° C. | | 451/498 |
| 90/95 | ° C. | | 590/655 |
| 98 | ° C. | | 719 |

The product yields are shown in Table 2. The steam stripping of the first stage effluent improved the mid-distillate yields by about 5 W % and lowered the naphtha and light gas produced by about 5 W % and 0.5 W %, respectively.

TABLE 2

| | Once-Through | Once-Through with Interstage Stripping |
|---|---|---|
| $H_2S$, W % | 2.58 | 2.58 |
| $C_1$-$C_4$, W % | 3.21 | 2.85 |
| Naphtha, W % | 25.16 | 19.77 |
| Mid-distillates, W % | 42.11 | 47.86 |
| Bottoms, W % | 29.60 | 29.60 |
| Total, W % | 102.65 | 102.65 |

The current invention utilizes a steam stripper to simulate a two-stage hydrocracking unit configuration by removing the H2S, NH3, light gases (C1-C4), naphtha and diesel products nominally boiling in the range 36-370° C. from the first stage effluents. The steam-stripped products will be free of H2S and NH3 and NH3 and will contain unconverted hydrocarbons, resulting in higher activity for the catalysts because there is no poisonous H2S and NH3, and higher mid distillate selectivity because the light products will not be subjected to further cracking.

Although the invention had been described in detail in several embodiments and illustrated in the figures, other modifications will be opponent to those of ordinary skill in the art from the description and the scope of the invention is to be determined by the claims that follow.

The invention claimed is:

1. A process for hydrocracking a hydrocarbon feedstock comprising the steps of:

supplying the feedstock and hydrogen to an input of a first stage reactor containing a first stage hydrocracking catalyst for removal of heteroatoms and cracking of high molecular weight molecules into lower molecular weight hydrocarbons to produce a first-stage reactor effluent; thereafter passing the first stage effluent to a steam stripper vessel to separate hydrogen, $H_2S$, $NH_3$, light gases ($C_1$-$C_4$), naphtha, and diesel products;

passing the stripper bottoms from the stripper vessel, and hydrogen, to a second stage reactor containing a second stage hydrocracking catalyst;

combining a hydrocracked effluent stream of the second stage reactor with the hydrogen, $H_2S$, $NH_3$, light gases ($C_1$-$C_4$), naphtha, and diesel products separated in the steam stripper vessel to form a combined product stream; and passing the combined product stream to a separation stage for separation of the components into predetermined product streams.

2. The process of claim 1, wherein the effluent stream from the first stage reactor is passed through a heat exchange steam generator prior to being passed to the steam stripper vessel.

3. The process of claim 1, wherein the effluent stream from the first stage reactor is passed through vapor/liquid separator stripper vessel to produce tops and bottoms, the bottoms being passed to the steam stripper vessel.

4. The process of claim 1, wherein the first stage hydrocracking catalyst is selected from the group consisting of amorphous alumina catalysts, amorphous silica alumina catalysts, zeolite-based catalysts, and a combination comprising at least one of amorphous alumina catalysts, amorphous silica alumina catalysts, and zeolite-based catalyst.

5. The process of claim 1, wherein the first stage hydrocracking catalyst further comprises an active phase of Ni, W, Mo, Co, or a combination comprising at least one of Ni, W, Mo, and Co.

6. The process of claim 1, wherein 10% to 80% by volume of hydrocarbons boiling above 370° C. at a hydrogen partial pressure in the range of 100200 kg/cm$^2$ are converted in the first reactor to one or more light gases selected from the group consisting of methane, ethane, propane, n-butane, isobutene, hydrogen sulfide, ammonia, naphtha fractions boiling in the range of 180° C. to 375° C., diesel fractions boiling in the range of 180° C. to 375° C., and combinations comprising at least one of the foregoing light gases.

7. The process of claim 1, wherein the first reactor is at a hydrogen partial pressure is in the range of 100-150 kg/cm$^2$.

8. The process of claim 1, wherein the flow of feedstock oil to the first reactor is in the range of 300-2000 m$^3$ over 1000 m$^3$ of hydrotreating catalyst per hour.

9. The process of claim 1, wherein the first or second reactor is a fixed-bed, an ebullated-bed, a slurry-bed, or a combination thereof.

10. The process of claim 1, wherein a portion of the effluent stream of hydrogen, $H_2S$, $NH_3$, light gases ($C_1$-$C_4$), naphtha, and diesel products removed from the steam stripper vessel are directed through a separator vessel to separate water, gas, and liquids; a sour diesel stream is also supplied to the separator vessel to mix with the effluent stream; and wherein the combined effluent stream/sour diesel stream is directed through a diesel hydrotreater unit to produce ultra-low sulfur diesel fuel.

* * * * *